United States Patent [19]

Brugnoli et al.

[11] 3,973,751

[45] Aug. 10, 1976

[54] SIPHON WITH PRESSURE PRIMING AND PNEUMATIC REFLUX

[76] Inventors: Maria Brugnoli, Via Torrevecchia 987; Francesco Amici, Piazza Cavour 17, both of Rome, Italy

[22] Filed: Mar. 24, 1975

[21] Appl. No.: 561,036

[30] Foreign Application Priority Data

Apr. 12, 1974 Italy ..... 50386/74

[52] U.S. Cl. ..... 251/61.1; 4/42; 4/65; 137/147

[51] Int. Cl.[2] ..... F16K 31/126; E03D 1/04

[58] Field of Search ..... 4/42, 52, 65, 67 R; 137/128, 142, 147, 148, 150; 251/12, 24, 61.1; 4/43

[56] References Cited

UNITED STATES PATENTS

| | | | |
|---|---|---|---|
| 2,606,326 | 8/1952 | Niccolai | 4/43 |
| 2,612,903 | 10/1952 | Carnerero | 137/148 X |

FOREIGN PATENTS OR APPLICATIONS

| | | | |
|---|---|---|---|
| 415,964 | 11/1946 | Italy | 137/142 |
| 39,243 | 4/1913 | Sweden | 4/43 |
| 4,479 | 3/1904 | United Kingdom | 4/43 |
| 305,331 | 2/1929 | United Kingdom | 4/43 |

*Primary Examiner*—Alan Cohan
*Assistant Examiner*—Gerald A. Michalsky
*Attorney, Agent, or Firm*—Silverman & Cass

[57] ABSTRACT

A liquid siphon including a tank and a pair of concentric shells within the tank. One end of the external-most shell has an enlarged bell part formed thereon. A deformable gasket is retained against an interior portion of the bell part to close the same. A passageway in the bell part communicates the interior thereof with the outside surface and is closed by the gasket when the same is deformed by priming the siphon.

4 Claims, 1 Drawing Figure

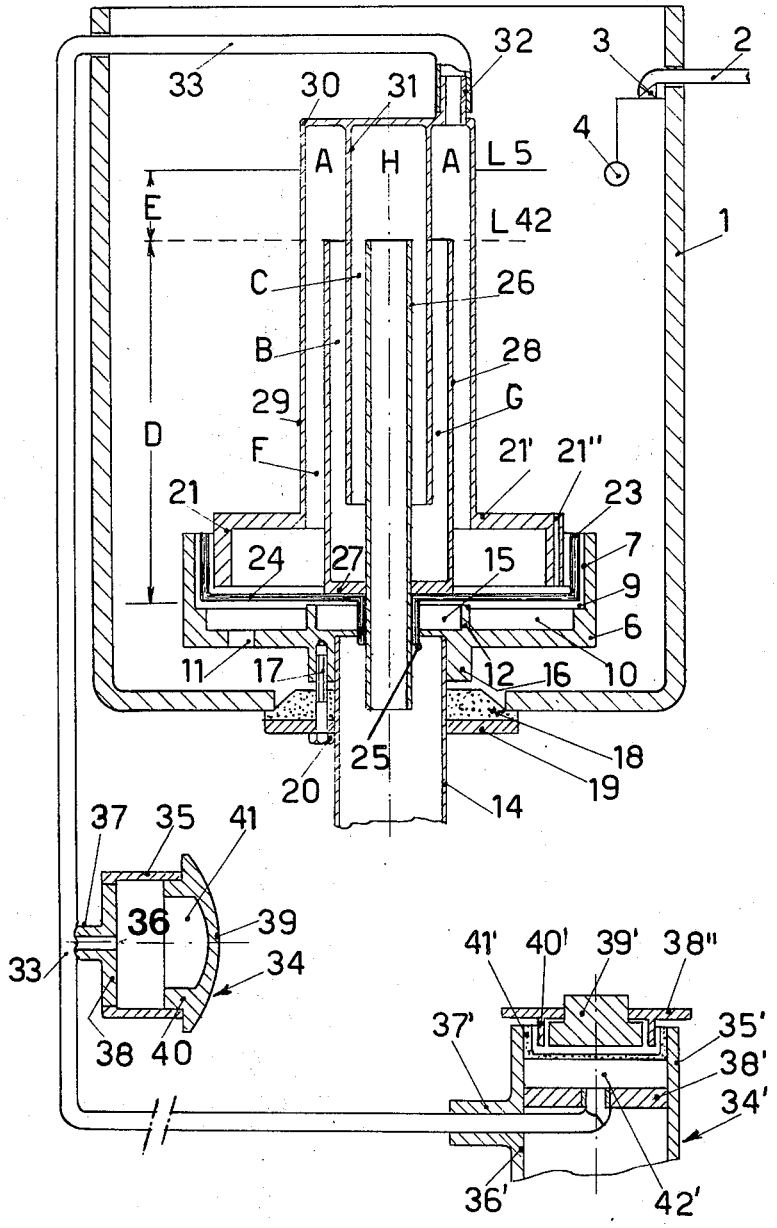
32
3
2
33
30
31
4
A
H
A
L5
E
L42
1
C
26
B
28
29
G
D
F
21'
21''
21
23
24
27
15
7
9
6
11
17
12
16
10
25
18
20
19
14
37
35
41
36
39
33
34
38
40
41'
40'
39'
38''
37'
35'
38'
34'
36'
42'

SIPHON WITH PRESSURE PRIMING AND PNEUMATIC REFLUX

BACKGROUND OF THE INVENTION

This invention relates to siphons provided with pressure priming and pneumatic reflux.

Siphons with pressure priming and pneumatic reflux are known. In essence the top of a bell siphon is fitted with a pipe for the discharge of liquid, a pipe for the injection or extraction of a gas (air), and a priming device which, in the resting state, maintains under pressure a volume of air trapped during the submergence of the siphon in order to prevent self priming. A suitable pump attached to the priming device displaces the volume of air by compression and reflux and causes the siphon to be primed, so permitting the discharge of the liquid contained in the tank.

Implementation of the earlier proposals, although demonstrating the validity of the principle involved, has revealed difficulties and complications in the manufacture and operation of some of the devices envisioned.

SUMMARY OF THE INVENTION

An object of this invention is to provide improvements or modifications of the earlier proposals which, although not altering the fundamental concept of the basic and complementary features, do allow the manufacture of a more simple siphon which is reliable in operation, and which can be effected by moulding plastic material. In addition to this, the siphon may be fitted without special attachements to discharge pipes of different diameter.

According to the present invention there is provided a siphon with provision for pressure priming and pneumatic reflux, and comprising first and second cylindrical shells each open at one end and each provided with an inner cylinder, the shells and cylinders being arranged coaxially and in spaced relationship to each other so as to form a series of three annular coaxial chambers whose walls define a labyrinth, an upper chamber, and a lower chamber.

The internal shell, which is open upwards in its operating position, has a base opening in which its cylinder, in the form of a pipe for the discharge of the volume of compressed air, is mounted, said pipe which may also be formed by moulding, projects into the liquid discharge pipe.

The external shell, which opens downwardly in its operating position, may also be formed by moulding and is provided internally with an integral cylinder. An important feature is that the external shell opens into a bell part at its bottom end.

The bell part provided at the open end of the external shell of the siphon is received by a gasket which also receives the cylindrical pipe of the internal shell at a point where the said pipe projects from the said internal shell.

According to another feature of this invention, a suitably shaped socket member receives the gasket, holding it in place, and provides a support for the gasket by means of an annular flange which holds the gasket above the base of the socket member. The socket is provided with at least one opening in its base.

An embodiment of the invention will now be described, by way of example, with reference to the accompanying drawing.

BRIEF DESCRIPTION OF THE DRAWING

The single FIGURE is a cross-sectional view of a siphon constructed in accordance with the invention.

DESCRIPTION OF THE PREFERRED EMBODIMENT

Referring to the drawing, reference 1 denotes a water tank into which water enters via pipe 2 through a conventional valve 3 which is controlled by a float 4 to interrupt the flow of water when the tank is full, that is when the liquid has reached level L5.

A shaped socket member 6 at the bottom of the tank 1 carries a gasket or membrane 24. The gasket extends upwardly to surround bell part 21 of external shell 29 of the siphon which carries internal cylinder 31 attached to upper end of the shell 29. A second or internal shell 28, which is open at the top, is fitted centrally with respect to the gasket 24, and its base 27 carries an internal cylindrical pipe 26 which projects and opens into liquid discharge pipe 14.

Examining the member 6 in detail, it will be seen that it has a skirt which extends upwards, opening in that direction. Internal surface 7 of the member 6 is arranged to receive skirt 23 of the gasket 24 which also extends upwards, and the internal surface of the skirt 7 is formed with a shoulder 9 on which the gasket 24 may be supported. A central annular flange 12 extends upwardly from the socket member 6 to provide a valve seat at its upper end for cooperation with the gasket 24. The internal shoulder 9 in the gasket 24, and the flange 12 act to define a chamber 10. The object of this chamber will be explained below. In addition, the member 6 is formed with an inner rib 15 on which the water discharge pipe 14 seats.

As described, the gasket 24 includes a vertical annular skirt 23 which surrounds the bell part 21 of the siphon shell 29. The gasket 24 is also formed with a central opening through which the pipe 26 extends, and a downwardly extending skirt 25 surrounds the external surface of the pipe 26.

It can thus be appreciated that a unit has been formed in which the member 6 is in connection to the gasket 24, with the external shell 29 of the siphon by means of the bell part 21, and with the internal shell 28 of the siphon by means of the pipe 26. These different components are then held together by close fitting one with another, or by other means. The result is a complex siphon in which there are formed above the internal shell 28 and the pipe 26 attached to it, and between the internal shell and the closed upper end 30 of the external shell 29, two chambers, A and H respectively, whose purpose will be explained below.

A rubber tube 32 from which extends an air tube 33 ending at a control valve, is connected to chamber A at a suitable point on top end 30 of the shell 29.

The socket member 6 is formed with openings 11 in its base, which place the chamber 10 in communication with the liquid contained in the tank 1. Also, at the end of the horizontal section 21' which connects the body of the shell 29 to the bell part 21, passageways 21'' are formed within the thickness of the wall forming the part 21, and the purpose of these passageways will be described below. Similarly, member 6 has a dependent annular flange 16 which receives the end of the pipe 14, according to another feature of this invention. The flange 16 has tapped bores 17 for fixing screws or bolts 20 which will be described below. A gasket 18 of frusto-conical shape is arranged below the flange 16, with its portion of greater diameter disposed outside the tank 1. Thus, when the bolts 20 are passed through a suitably drilled washer 19 and the gasket 18 to enter the tapped bores in the flange 16, and the bolts are tightened, the gasket 18 is deformed to form a sealing closure for the annular space existing between the pipe 14 and the central opening in the bottom of the tank 1. This is one of the advantages of the present construction and, as a result, it is possible to use a pipe 14 and a tank 1 whose relevant diameters are substantially different, and without requiring close tolerances between them. At the same time, the siphon assembly is securely held in place by the washer 19 which holds the member 6 against the bottom of tank 1, as shown in the drawing.

In the drawing, the following reference letters denote the following items:

- L5 is the maximum level of the contents of tank 1;
- L42 is the level of liquid in tank 1 corresponding to the top of the internal shell 28;
- A is the annular chamber or cavity between the siphon shell 29 and the pipe 31, above the internal shell 28;
- B is the annular chamber or cavity between the internal shell 28 and the cylinder 31;
- C is the chamber or cavity between the cylinder 31 and the cylindrical pipe 26;
- D is the height of a column of liquid between the base of the gasket 24 and the upper edge of the shell 28;
- E is the height of a column of liquid between L42 and L5;
- F is the annular chamber or cavity between the shell 29 and the cylinder 28;
- G is the volume of liquid in the annular chamber B when the liquid has reached the level L5,
- H is the cylindrical chamber or cavity in the cylinder 31 between the upper end of the pipe 26 and the top end 30 of the external shell 29.

In order to explain the operation of the above siphon, it will be assumed that tank 1 is initially empty, the siphon correspondingly is in the discharged state, and the gasket 24 engages the valve seat provided by the top of flange 12. If now water is caused to flow into tank 1 through valve 3, the water will reach the upper surface of the part 21′ and will flow into the space above the gasket 24 through passageways 21″, thus increasing the pressure of the gasket on the seat of flange 12. As the liquid leaves tank 1 it enters the chamber F and, when the liquid in the tank has reached the level L42, the water within the siphon will be at the level corresponding to the top end of the shell 28 to form a column of liquid of height D from the base of the gasket 24 and reaching up, as mentioned, to the top edge of shell 28. As the level of water rises in tank 1, the water in chamber F will spill over the edge of shell 28, falling into the chamber B from which it will rise into chamber C to prevent the escape of the air contained in chambers A and B. This forms a volume of air which is increasingly compressed as the column of liquid in chamber C rises.

When the level of liquid in tank 1 rises from level L42 to L5, chamber C gradually fills with liquid and, at the same time, the volume of air originally contained in chambers A and B, in tube 33, and in the dead spaces of the activating pump, will be compressed proportionately as a result of the increasing load of the hydrostatic head in chamber C. As a consequence, these volumes of air are reduced, and the difference between the initial volume and the reduced volume is taken up by a corresponding volume of liquid G contained in the lower part of chamber B.

When the liquid in the tak reaches level L5 valve 3 closes under the action of the float 4, and the siphon remains in a stable state with the volume of compressed air contained in chambers A and B – G counterbalanced by two opposing hydrostatic heads C – G and E of equal value.

If air is now passed under pressure through tube 33 to increase the pressure of the column of compressed air in the dead spaces of the pump, in the tube 33, and in the chambers A and B, air will enter into chamber A and lower the levels of liquid in chambers F and B. Because of the effect of this change in level, part of the air will pass into chamber C mixing with the water contained in it and decreasing the hydrostatic head. The external hydrostatic head E, which remains constant, overcomes the equilibrium and initiates the circulation of liquid within the siphon, the liquid acquiring a velocity suitable for the complete aspiration of the residual air in chamber B and in part of chamber A. This phenomenon occurs primarily as a result of the aspiration caused by the release of the activating pump and, therefore, by the return of air to the dead spaces in the pump. The water in tank 1 discharges via the discharge pipe 14 through the passageways 21″, the bell part 21, chambers F, A, B and C, and the pipe 26.

If the parts of the siphon in contact with the liquid are suitably adjusted, particularly in level, low pressure is produced in the shell 31 by water which has passed through the pipe 26, and this low pressure raises the gasket 24 off the seat of flange 12. The gasket rises to close the passageways 21″. Raising of gasket 24 partly opens the valve provided by the flange 12, and therefore opens a route for the discharge of water from the tank through the openings 11. As a result of the upward pressure of the water from tank 1 passing through the openings 11, the gasket 24 is pressed further to allow the rate of discharge to increase. The water entering into pipe 14 carries over a certain quantity of the air originally contained in that pipe, and causes a drop in pressure at the top of the pipe which is communicated through pipe 26 to the interior of the siphon. This low pressure raises the gasket 24 even further from the seat of the flange 12.

When the liquid in tank 1 drops to the level of the openings 11, air enters the pipe 14 which is emptied of water and returns to atmospheric pressure. Now, when the interior of the siphon is almost full of water and under low pressure, and the chamber H returns to ambient pressure of pipe 26, the liquid in chambers C and B, and in part in chambers A and F, is drawn down by the gasket 24 which falls in the bell part 21. The gasket 24 therefore falls and seats on the flange 12, thus closing the valve, and at the same time moves away from the passageway 21″ to open the passageways. The initial condition is thus restored, although some of the liquid remains in chambers B and C.

It should be noted that, in the following cycles which are repeated during the operation of the siphon, the water contained in chambers B and C resists the head of liquid which forms outside the siphon while tank 1 is being filled since, in this case, the volume of air contained in the annular chambers E, A and B, pipe 33, and the pump, will be compressed before the level of the liquid reaches L42. Consequently, the head of liquid volume is cancelled, C achieves its full height, E is as high as C, and L5 will increase by the height of G.

Obviously, as in other siphons, the level L5 is at the ideal point for operation of the siphon, since it can be primed by a slightly lower level and will be primed automatically by a higher level.

As will now be appreciated, the operation of the siphon according to this invention is extremely simple and reliable, and requires minimum effort on the part of the user, given that a pressure exceeding only a few tens of centimetres of water must be applied.

Another important feature of this invention is the arrangement of pneumatic valves 34 and 34'. The said valves are of two types which may be mounted in alternative positions, i.e. on a wall and/or a floor. In fact, both valves, which are important for the operation of the siphon according to the invention, should fulfill the requirement of complete reliability, extreme simplicity and, at the same time, extremely economical operation.

Referring again to the drawing, the valve designated 34 comprises a barrel 35 which is connected by a pipe 37 to the tube 33. At the inner end of the valve there is a disc 38 preferably of rubber, with a central opening 36 which connects to the pipe 37. The disc 38 is inserted into barrel 35 under pressure and hermetically sealed in position. At the outer end of the barrel 35 there is fitted a cap 39 of resilient material. The cap projects beyond the barrel 35 and has an axial spigot part 40, preferably in the form of a frusto-cone, so as to seal hermetically with the internal wall of the barrel 35. Compression of the cap 39 compresses the air which is already pressurised as a result of the head in tank 1, as mentioned above, and the increase of pressure in tube 33 primes the siphon in the manner described.

The same result can be achieved by means of the pump denoted by reference 34', in which a barrel 35' is formed with a side 36' for the tube 33 which passes through a boss 37'. The tube 33 is attached to a resilient disc 38' which is secured in the barrel 35'. A cap 38'' is formed with a central opening for a push-button 39', and has an integral cylindrical flange 40'. A shaped resilient ring 41', which ensures a hermetic seal between space 42' and atmosphere, is arranged between the external wall of the flange 40' and the internal wall of pipe 35'. The gasket 41' is preferably cup shaped and its which engages push button 39' is sufficiently elastic to be deformed by the push button. Deformation of the gasket 41' compresses the air within chamber 42', and the siphon then operates as described above.

What we claim is:

1. A liquid siphon comprising, a tank, an inner shell and an external shell disposed within the tank, each shell being open at one end and each provided with an inner cylinder, the shells and cylinders being arranged coaxially spaced with respect to each other so as to form a series of annular coaxial chambers, the end of the external shell being enlarged to form a bell part defining an interior portion thereof, a deformable gasket disposed about said bell part to close said interior portion, the bell part having an external wall opposite the interior portion and at least one passageway formed in said external wall to communicate the interior portion with the outside thereof, said passageway being closed by the gasket when the gasket is deformed by priming of the siphon with liquid and discharge of the liquid from the tank.

2. A liquid siphon as claimed in claim 1 in which the tank includes a socket member, said gasket being retained within the socket member against the bell part, the socket member having an internal shoulder to support the periphery of the gasket and a central flange forming a valve seat for contact with the gasket, the base of the socket member between the shoulder and the seat having at least one opening for the passage of liquid therethrough and a central annular flange extending downwardly to receive a liquid discharge pipe at the bottom of the tank.

3. A liquid siphon as claimed in claim 2 including a frusto-conical gasket arranged around the discharge pipe, an external washer fastened to the downwardly extending annular flange so as to compress the frusto-conical gasket and form a seal between the tank and the liquid discharge pipe.

4. A liquid siphon as claimed in claim 1 including a priming pump having a fluid-tight chamber, a resilient member disposed in the fluid-tight chamber, a conduit connecting the pump with the tank, and means on the pump to increase the pressure therein initially and to decrease it subsequently by deformation of the resilient member.

* * * * *